United States Patent [19]

Nielsen, Jr.

[11] 4,289,000

[45] Sep. 15, 1981

[54] PICK-RESISTANT TUBULAR LOCK AND KEY FOR OPERATING THE SAME

[75] Inventor: Anker J. Nielsen, Jr., Holden, Mass.

[73] Assignee: Omco, Inc., Holden, Mass.

[21] Appl. No.: 66,479

[22] Filed: Aug. 13, 1979

[51] Int. Cl.[3] ..... E05B 67/36

[52] U.S. Cl. ..... 70/34; 70/398

[58] Field of Search ..... 70/34, 33, 32, 386, 70/395, 397, 398, 409

[56] References Cited

U.S. PATENT DOCUMENTS

| | | | |
|---|---|---|---|
| 3,714,802 | 2/1973 | Morse | 70/34 |
| 3,835,674 | 9/1974 | Hoyt | 70/34 |
| 4,040,279 | 8/1977 | Sigmorelli | 70/34 |

*Primary Examiner*—Robert L. Wolfe

*Attorney, Agent, or Firm*—Thompson, Birch, Gauthier & Samuels

[57] ABSTRACT

A conventional tubular lock is made pick-resistant by the inclusion of a specially designed washer. The washer, which has a non-circular opening, is provided in the lock interior. The washer is preferably located between the helical compression spring and the rear face of the slidable plunger. The opening in the washer permits the insertion of a specially shaped expandable key, but does not permit the insertion of an old style expandable key, or a nail or other similarly round picking tool which has a sufficiently large diameter to wedge in the rear bore of the plunger. Therefore, the specially designed washer permits the lock to be opened only by an authorized key, but not by a nail or an unauthorized key.

8 Claims, 14 Drawing Figures

PICK-RESISTANT TUBULAR LOCK AND KEY FOR OPERATING THE SAME

BACKGROUND OF THE INVENTION

This invention relates to tubular locks and expandable keys of the type shown and described in Morse and Nielsen, U.S. Pat. No. 3,714,802; and in Hoyt, U.S. Pat. No. 3,835,674. These two patents illustrate the problem of making locks pick-resistant, and show two solutions which have proved less than entirely successful.

Locks for electric meter boxes have traditionally been openable only by keys provided to the utility companies by the lock makers. Special tubular locks have been openable only by special expandable keys. However, over the years, the special tubular locks have begun to be opened by unauthorized persons for the purpose of bypassing the meters (i.e. to obtain "free" electricity). Such illegal meter box openings are usually carried out in either of two ways.

First, the special expandable keys have fallen into unauthorized hands over the years. Obviously, such special keys can be used to open the special tubular locks that they were designed to open. Therefore, one object of this invention is to provide a modified lock which cannot be opened by the old style special expandable key. It is another object of this invention to provide a modified expandable key which can open the modified tubular lock, and which can also open the old style tubular lock.

Second, the special tubular locks can also be opened by picks, or by nails or screws driven into the tubular locks. These picks or nails or screws will wedge solidly in the moving parts of the lock, and the moving parts can then be retracted to open the lock. It is an object of this invention to provide a modified tubular lock that cannot be opened by such wedging tactics.

It is another object of this invention to provide a method for modifying conventional tubular locks and conventional expandable keys to fabricate the locks and keys of this invention.

SUMMARY OF THIS INVENTION

The prior art locks and keys of U.S. Pat. Nos. 3,714,802 and 3,835,674 form the basis of this invention. That is, it is the substitution of parts in these prior art locks, and the reshaping of parts in these prior art keys, which constitutes the present invention.

As is true in the prior art, the lock of the present invention includes an elongated tubular lock housing which has two diametrically opposed ball wells. Each ball well contains a hardened steel ball, which is retained in the well, but which is free to move from an unlocking position, in which the ball does not protrude out of the well, to a locking position, in which the ball does protrude out of the well.

In the locking position, the protruding balls extend behind a fixed standard which is bolted to the meter box. Thus, the lock is immobilized. In the unlocking position, the ball descend in their wells and the lock can be moved away from the fixed standard to unlock the meter box.

The prior art locks and the lock of the present invention all have an elongated tubular lock housing which contains a reciprocating plunger. The plunger is spring-biased forwardly by a helical compression spring. An expandable key is inserted into the lock housing and enters the rear bore of the plunger. The key is expanded into solid frictional engagement with the plunger permitting the plunger to be retracted against spring pressure within the lock housing. Retraction of the plunger permits the balls to descend in their wells and the lock to be pulled away from the fixed standard. This is all conventional.

The present invention provides a special washer preferably positioned between the rear face of the plunger and the front face of the compression spring. The washer has a specially designed non-circular opening which will not permit the passage of a conventional expandable key or nails that are large enough to wedge in the rear bore of the plunger. This invention also provides a specially designed expandable key which has a non-circular shape and size chosen to exactly pass through the specially designed washer. This invention also provides a method for modifying conventional locks and keys in order to fabricate the new locks and keys of the present invention.

DESCRIPTION OF THE PREFERRED EMBODIMENT

Figure 1:
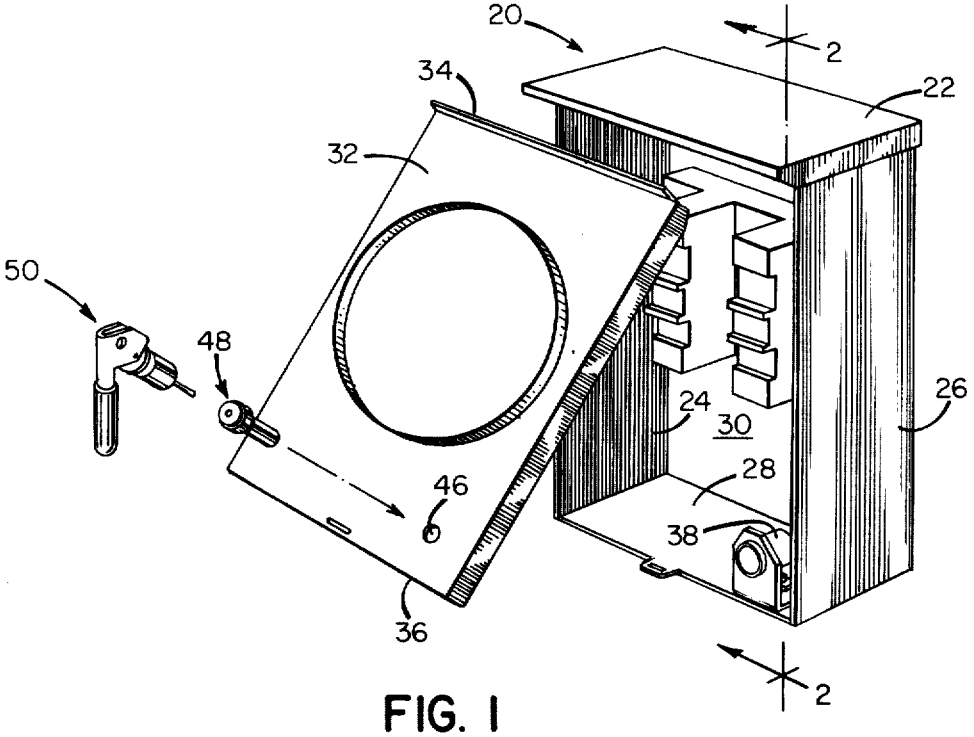
FIG. 1 is a perspective view of an electric meter box which can be locked using this invention. The box lid, the lock, and the key are shown in an exploded arrangement.
Figure 2:
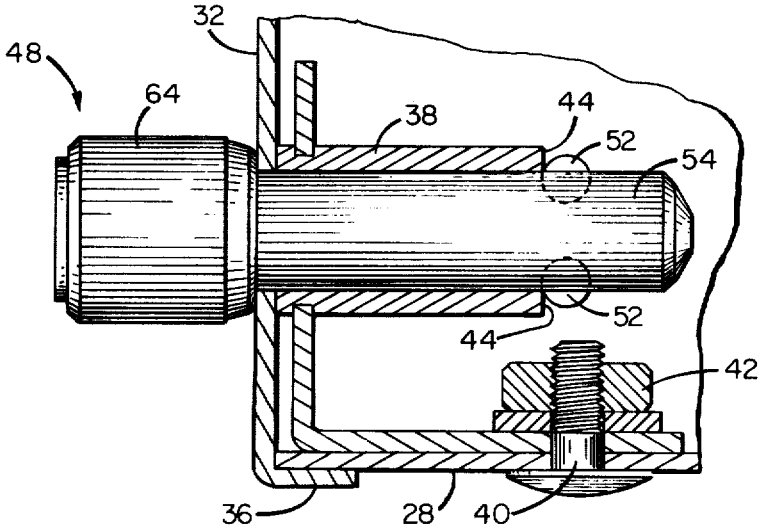
FIG. 2 is a view of FIG. 1 taken along line 2—2, the box lid being closed, the lock being in its locked position, and the key not being shown.

FIG. 1 shows a typical electric meter box 20 (without the meter). Box 20 has a top 22, two sides 24 and 26, a bottom 28, and a mounting wall 30, all five pieces being fixed together. Box 20 also has a removable door 32 which has an outwardly extending top lip 34 for hinge attachment to box top 22. Door 32 has an inwardly extending bottom lip 36 for fitting under box bottom 28, as shown in FIG. 2.

A tubular fixed standard 38 is bolted to the bottom 28 of box 20 by bolt 40 and nut 42. The fixed standard 38 has an inwardly spaced annular bearing surface 44. The box door 32 has a lock opening 46 formed therein in alignment with tubular fixed standard 38.

A tubular lock 48 and an expandable key 50 are used to lock box door 32 in its closed position against box bottom 28. As can be seen in FIG. 2, when the door 32 is locked, the lock's locking balls 52 protrude from the lock's tubular lock housing 54 and bear against annular bearing surface 44 of fixed standard 38. When the door 32 is unlocked, locking balls 52 descend and do not protrude from lock housing 54. All of the preceding description is entirely conventional and does not need to be described here in further detail.

Figure 3:
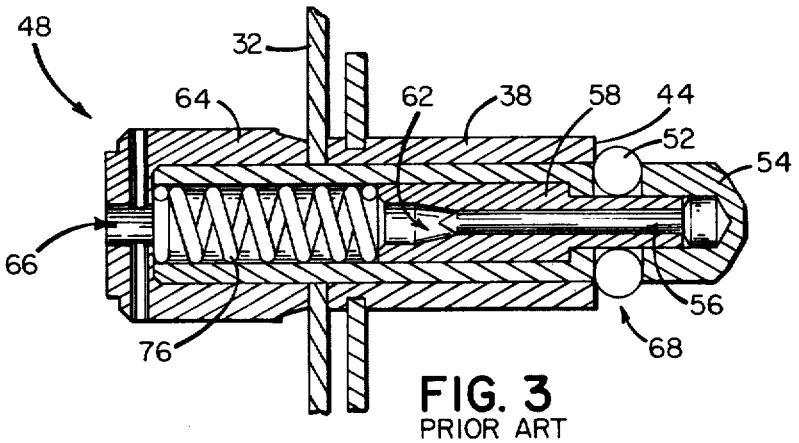
FIG. 3 PRIOR ART
FIG. 3 is an elevation, in section, of a prior art lock in its locked position.
Figure 4:
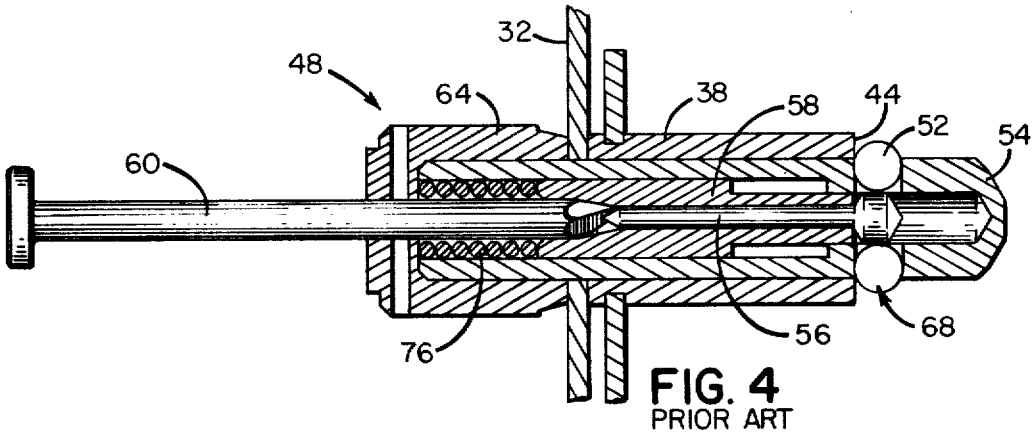
FIG. 4 PRIOR ART
FIG. 4 shows the FIG. 3 prior art lock with a nail driven into the lock. The lock plunger has been retracted, but the lock remains in its locked position.

FIGS. 3 and 4 are illustrations of the prior art construction which is shown in Hoyt, U.S. Pat. No. 3,835,674. The entire disclosure of that patent is incorporated herein by reference. In the Hoyt patent, a special pin 56 is provided within lock housing 54 and slides relative to lock plunger 58. In the event that a nail 60 is driven into lock 48, the nail does not solidly wedge in the concave cup-shaped rear face 62 of plunger 58 whereby the plunger could be retracted to release the locking balls to open the lock. Instead, the nail 60 solidly wedges into engagement with special pin 56 whereby when the plunger 58 is retracted, the locking balls 52 are not released, and the lock is not opened.

However, the improper use of a nail in this fashion has often mangled the special pin 56 and has damaged the lock 48. It is one of the objects of the present invention to prevent this type of damage from occurring.

The lock portion of the present invention is clearly shown in FIGS. 5–8. Lock 48 has an elongated hollow tubular lock housing 54. The forward end of housing 54 is closed. The rearward end of housing 54 is closed by an enlarged cap 64 which forms the rear wall of the lock housing and is an integral part thereof. A key hole 66 is formed along the axis of cap 64.

Two diametrically opposed ball wells 68 are formed transversely through lock housing 54 near its closed forward end. The wells 68 are identical to each other and open at both the interior and the exterior surfaces of lock housing 54. Each well has a very small flange at its exterior rim. This rim is too small to be visible in the drawings. The flanges limit the outward movement of locking balls 52 within wells 68.

A plunger 58 is slidably contained in lock housing 54. Plunger 58 is cylindrical, but has three different diameters. The plunger's forward portion 70 has the smallest diameter. Middle portion 74 has the intermediate diameter. Rearward portion 74 has the largest diameter. Rearward portion 74 has the function of bearing against the interior walls of lock housing 54 as plunger 58 slides between its locking position and its unlocking position.

Figure 5:
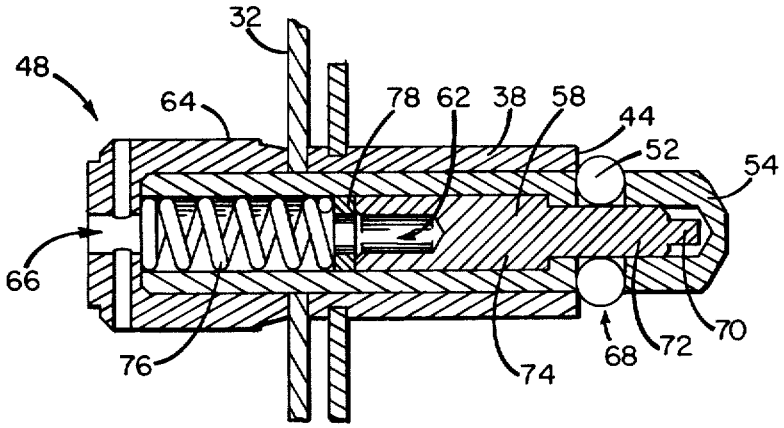
FIG. 5 is an elevation, in section, of the lock of the present invention in its locked position.
Figure 6:
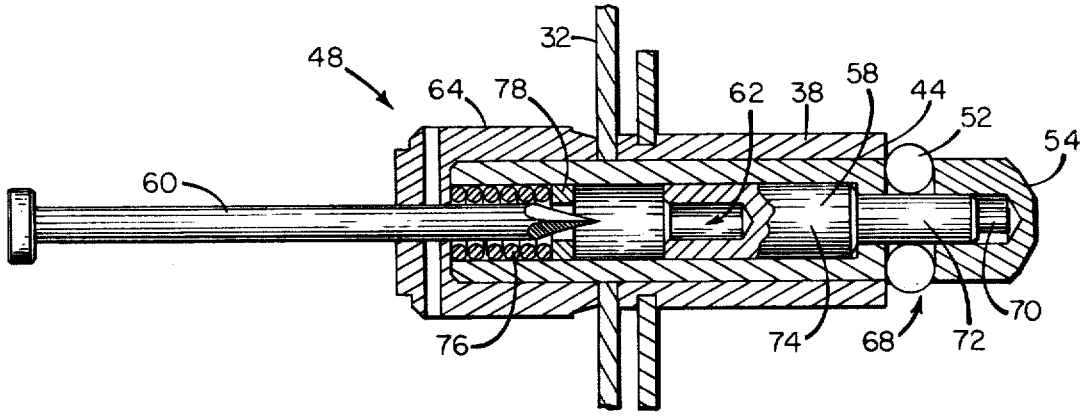
FIG. 6 shows the lock of FIG. 5 still in its locked position despite the presence of a nail driven into the lock. The nail has become wedged in the washer, and the nail and the washer have been retracted against spring pressure. The lock plunger and the locking balls have not moved at all.

FIG. 5 shows the locking position in which plunger 58 is biased forward by compression spring 76, and locking balls 52 are urged outwardly by middle portion 72 of plunger 58. Balls 52 interact with annular bearing surface 44 of fixed standard 38 to immobilize lock 48 to hold door 32 closed.

Figure 14:
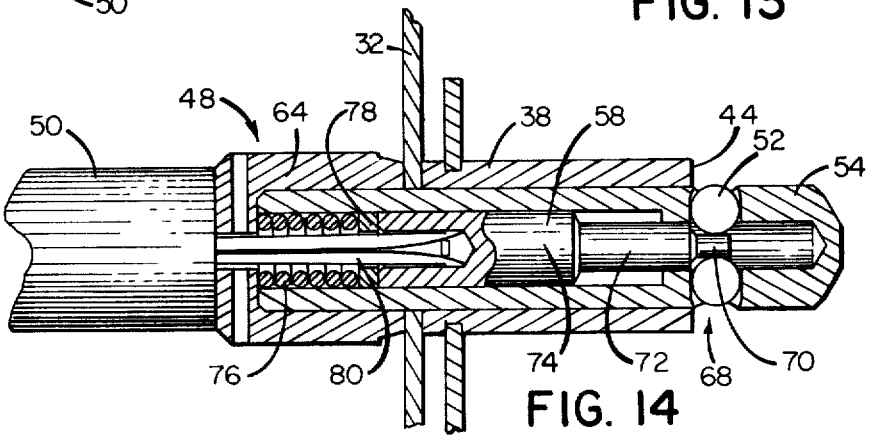
FIG. 14 is a side elevation of the special key inserted into the special lock. The key has been expanded, the lock plunger has been retracted, the locking balls have dropped in their wells to their unlocking position, the lock has been opened, and the meter box lid can be opened.

FIG. 14 shows the unlocking position in which plunger 58 has been pulled backward by the action of expanded key 50. Spring 76 has been compressed. Locking balls 52 are no longer urged outwardly by the plunger's middle portion 72 and are free to fall in their wells 68 against the plunger's foward portion 70. The balls are now below the exterior surface of lock housing 54. Thus, the interconnected key 50 and lock 48 and door 32 can be pulled rearwardly so as to clear the fixed standard 38 and to open the door 32. The preceding description has still been substantially conventional.

The two critical elements of this invention are the provision of a special washer 78 in the lock, and the reshaping of the split sleeve 80 of the key.

Figure 7:
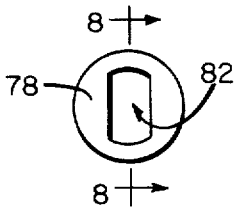
FIG. 7 is a front elevation of the special washer.
Figure 8:
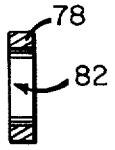
FIG. 8 is a view of the washer shown in FIG. 7, taken along line 8—8.
Figure 9:
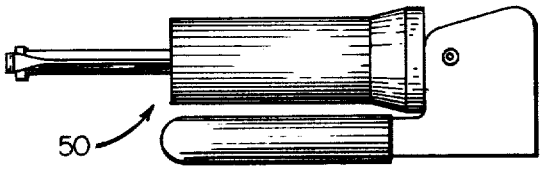
FIG. 9 is a side elevation of the special expandable key used with the lock of this invention.
Figure 10:
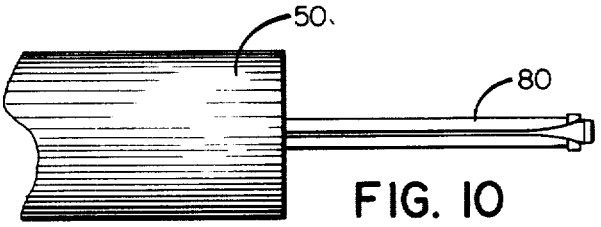
FIG. 10 is a side elevation of the forward portion of the key shown in FIG. 9. The cam pin has not been retracted, and the split sleeve has not been expanded.

Washer 78 is shown in FIGS. 7 and 8. The washer has a circular circumference and a non-circular central opening 82. Preferably, opening 82 is rounded at the top and bottom and is straight at the sides. However, the shape may be varied and still be within the scope of this invention. The shape of central opening 82 must be such that an old style expandable key will not pass through the washer. Thus, the lock of this invention cannot be opened by an old style key. Also, the shape or size of central opening 82 must be such that a relatively large diameter nail (e.g. larger than 0.122 inches/0.31 centimeters) will not pass through the washer. Thus, the lock of this invention cannot be picked by a relatively large diameter nail. In both cases (the old style key and the relatively large diameter nail), the key or nail will be blocked by washer 78 from entering the bore 62 of plunger 58. Alternatively, the key or nail will wedge in opening 82 of the washer 78. When the wedged key or nail is then retracted, the washer 78 (but not the plunger 58) will be the only element which will be retracted against spring pressure. The locking balls 52 will remain in their locking position because plunger 58 will not have been moved at all.

The conventional expandable key has a circular circumference (when viewed from the front). Preferably, central opening 82, of the present invention as shown in FIG. 7, has the same diameter vertically, but has a shorter dimension horizontally. Thus, the conventional key cannot pass through washer 78. Also, the maximum diameter of a nail which can pass through washer 78 is limited by the horizontal dimension of central opening 82.

The only changes which need to be made to a conventional old style lock to convert it into a new style lock are to shorten spring 76 and to insert washer 78 between spring 76 and the rear face of plunger 58. Everything else is left in conventional form.

Figure 11:
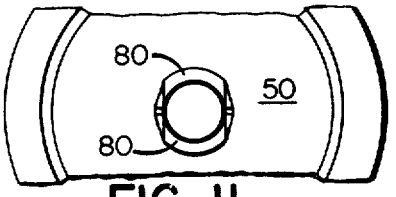
FIG. 11 is an enlarged front elevation of the FIG. 10 key.
Figure 12:
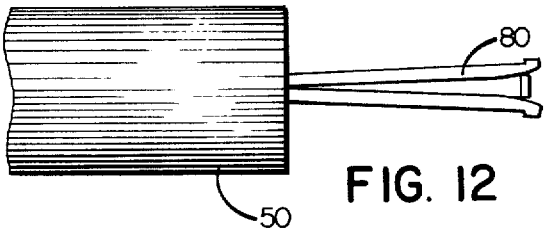
FIG. 12 is a side elevation of the forward portion of the key shown in FIG. 9. The cam pin has been retracted, and the split sleeve has been expanded.
Figure 13:
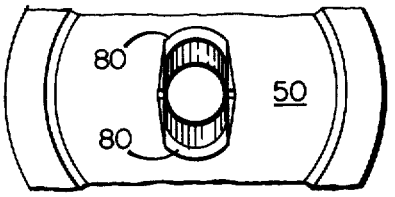
FIG. 13 is an enlarged front elevation of the expanded FIG. 9 key.

The only changes which need to be made to a conventional old style key to convert it into a new style key are to grind the sides of the forward portions of the split sleeve 80 and to grind the head of the center pin so that will fit through the opening of washer 78 (see FIGS. 11 and 13). Before grinding, a conventional key has a circular front profile. After grinding, the key will have a profile which will permit the key to pass through central opening 82. FIG. 14 shows that the non-circular split sleeve profile must extend at least from the forward tip of the split sleeve back a distance equal to or greater than the combined dimensions of plunger bore 62 plus washer opening 82. This is because that much of the split sleeve 80 must pass through washer opening 82 in order to permit the key to properly operate to open the lock. It will be understood that after grinding the split sleeve, the new style key will still be capable of opening the old style lock.

The locking and unlocking operation will now be described in detail. To lock box door 32 in its closed position, the top lip 34 of box door 32 is first hinged to box top 22. Then, key 50 is inserted into lock 48 and the key is operated to place the lock in its unlocking position (see FIG. 14). The door is then closed, the lock 48 (still interconnected to key 50) is inserted through lock opening 46 and through fixed standard 38 (see FIG. 14). Then, key 50 is operated to place the lock in its locking position with balls 52 extended beyond annular surface 44 of standard 38 (see FIG. 5). The key is then removed leaving the door locked. To unlock the door, the reverse procedure is followed. The locking or unlocking procedures each take only a few seconds to complete.

The foregoing description and drawings are intended solely to illustrate a preferred embodiment of this invention. There are many obvious modifications which could be made by one skilled in the art without departing from the spirit of this invention. Only the claims define and limit the scope of this invention.

I claim:

1. In a conventional tubular lock having an elongated tubular lock housing which has an axial key hole in its rear wall, two diametrically opposed ball wells formed transversely through the lock housing, the ball wells opening at the inner and the outer cylindrical surfaces of the hollow lock housing, a locking ball sliding in each ball well and being prevented from outward escape therefrom, a cylindrical plunger having a concave cupped rear face, the plunger sliding within the elongated lock housing and slidably engaging the undersides of the locking balls, the plunger being exteriorly shaped to urge the balls outwardly as the plunger slides forwardly to its locking position, and to release the balls so that they drop inwardly as the plunger slides rearwardly to its unlocking position, and a compression spring positioned in the lock housing between the rear wall of the lock housing and the rear face of the plunger, the spring normally biasing the plunger to its locking position, the improvement therein comprising: a washer having a periphery shaped and sized to telescopically fit coaxially within the hollow lock housing and positioned between the rear wall of the lock housing and the rear face of the plunger, said washer having a non-circular central opening through which a conventional expanding key having a circular profile cannot be inserted.

2. The improved tubular lock of claim 1 wherein said washer is positioned between the front face of the spring and the rear face of the plunger.

3. The improved tubular lock of claim 1 wherein said washer is an unattached separate element.

4. The improved tubular lock of claim 1 wherein said washer has a non-circular central opening which blocks the passage of a conventional expandable key.

5. The improved tubular lock of claim 1 wherein said washer has a non-circular central opening which blocks the passage of nails having a diameter larger than 0.122 inches (0.31 centimeters).

6. The improved tubular lock of claim 1 in combination with an improved conventional expandable key, the key having an axially movable large headed pin, and a split sleeve sheathing the pin, the split sleeve expanding as the pin is retracted, the improvement to the expandable key comprising: the forward portion of said split sleeve being shaped to have a non-circular cross-sectional circumference when unexpanded which corresponds to and is slightly smaller than the non-circular central opening of said washer.

7. The improved tubular lock of claim 6 wherein said split sleeve forward portion shape is curved on the top and bottom and is straight on the sides.

8. The method of modifying a conventional tubular lock and a conventional expandable key to prevent the opening of a modified lock by a conventional key or by a nail having a diameter greater than 0.160 inches (0.41 centimeters), and to permit the opening of both a modified and a conventional lock by a modified key, said method comprising the following steps in any order:

(a) inserting a washer between the rear wall of the elongated lock housing and the rear face of the plunger, said washer having a non-circular central opening; and (b) reshaping the circumference of the forward portion of the unexpanded split sleeve so that the circumference is non-circular and corresponds to and is slightly smaller than the non-circular central opening of said washer.

* * * * *